US011819992B2

(12) United States Patent
Liou

(10) Patent No.: US 11,819,992 B2
(45) **Date of Patent: *Nov. 21, 2023**

(54) HAMMER TOOL

(71) Applicant: Tang Chou Industrial Co., Ltd., Nantou County (TW)

(72) Inventor: Mou-Tang Liou, Taichung (TW)

(73) Assignee: Tang Chou Industrial Co., Ltd., Nantou County (TW)

( * ) Notice: Subject to any disclaimer, the term of this patent is extended or adjusted under 35 U.S.C. 154(b) by 728 days.

This patent is subject to a terminal disclaimer.

(21) Appl. No.: 16/936,691

(22) Filed: Jul. 23, 2020

(65) Prior Publication Data

US 2022/0024023 A1 Jan. 27, 2022

(51) Int. Cl.

| | |
|---|---|
| ***B25D 1/04*** | (2006.01) |
| ***B25G 1/00*** | (2006.01) |
| ***B25G 1/10*** | (2006.01) |
| ***B25G 3/34*** | (2006.01) |

(52) U.S. Cl.

CPC ..... *B25D 1/04* (2013.01); *B25G 1/00* (2013.01); *B25G 1/10* (2013.01); *B25G 3/34* (2013.01); *B25D 2250/051* (2013.01); *B25D 2250/065* (2013.01)

(58) Field of Classification Search

CPC . B25D 1/04; B25D 1/045; B25D 1/12; B25D 2250/051; B25D 2250/065; B25D 1/00; B25D 1/02; B25D 1/14; B25D 1/16; B25G 1/00; B25G 1/01; B25G 1/10; B25G 3/00; B25G 3/34; B25G 1/02; B25G 1/04; B25G 1/06; B25G 1/08; Y10T 403/4966; Y10T 403/4391; Y10T 403/32245

See application file for complete search history.

(56) References Cited

U.S. PATENT DOCUMENTS

| | | | | | |
|---|---|---|---|---|---|
| 587,154 | A * | 7/1897 | Minnemeyer | B25D 1/00 | 403/216 |
| 1,707,787 | A * | 4/1929 | Estwing | B25G 1/10 | 81/22 |
| 2,021,490 | A * | 11/1935 | Rigandi | B25G 3/28 | 403/248 |
| 2,467,284 | A * | 4/1949 | Williams | B25G 1/10 | 81/20 |
| 5,916,338 | A * | 6/1999 | Bergkvist | B25D 1/12 | 81/22 |
| 11,491,627 | B2 * | 11/2022 | Liou | B25G 3/18 | |

FOREIGN PATENT DOCUMENTS

| | | |
|---|---|---|
| TW | 294100 | 12/1996 |

* cited by examiner

*Primary Examiner* — Robert J Scruggs

(57) ABSTRACT

A hammer tool includes a head and a handle coupled to the head. The handle has a first and a second connecting end fixed to the head. The handle has a first and a second medial section and the first and the second connecting ends extend from the first and the second medial sections respectively. The first and the second medial sections are disposed side by side. The first and the second medial sections form at least one first and at least one second curved sections respectively. The at least one first and the at least one second curved sections abut against each other.

18 Claims, 7 Drawing Sheets

HAMMER TOOL

BACKGROUND OF THE INVENTION

1. Field of the Invention

The present invention relates to a tool and, particularly, to a hammer tool with a strong connection between a head and a handle.

2. Description of the Related Art

TW Pat. No. 294100 discloses a hammer comprising a head and a handle and including a fixing device for securing the handle to the head. An end of the handle is connected to the head. The handle defines a groove receiving a fixing structure. The fixing structure includes a nail plug with at least one retaining tooth and a nail. The nail plug defines a through hole receiving the nail. The through hole has an inner inclined surface, an entrance at an end of the inclined surface and an outwardly expanding section at the other end. The expanding section has a smaller diametrical size than the nail plug. The nail plug can be forced to expand by the nail so as to secure the handle to the head. The nail plug has a plurality of notches that facilities the expansion thereof.

The above-mentioned fixing structure is only useful when securing a head to a wooden handle. The problem is that the wooden handle wears, deforms and deteriorates easily after a long period of use. Consequently, the fixing effect of the fixing structure is lessened. Even worse, the head can detach from the handle.

The present invention is, therefore, intended to obviate or at least alleviate the problems encountered in the prior art.

SUMMARY OF THE INVENTION

According to the present invention, a hammer tool includes a head and a handle coupled to the head. The handle has a first and a second connecting end fixed to the head. The handle has a first and a second medial section and the first and the second connecting ends extend from the first and the second medial sections respectively. The first and the second medial sections are disposed side by side. The first and the second medial sections form at least one first and at least one second curved sections respectively. The at least one first and the at least one second curved sections abut against each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

DETAILED DESCRIPTION OF THE INVENTION

FIGS. 1 through 5 show a hammer tool 10 in accordance with the present invention. The hammer tool 10 includes a head 20 and a handle 30 tightly coupled to the head 20.

Figure 1:
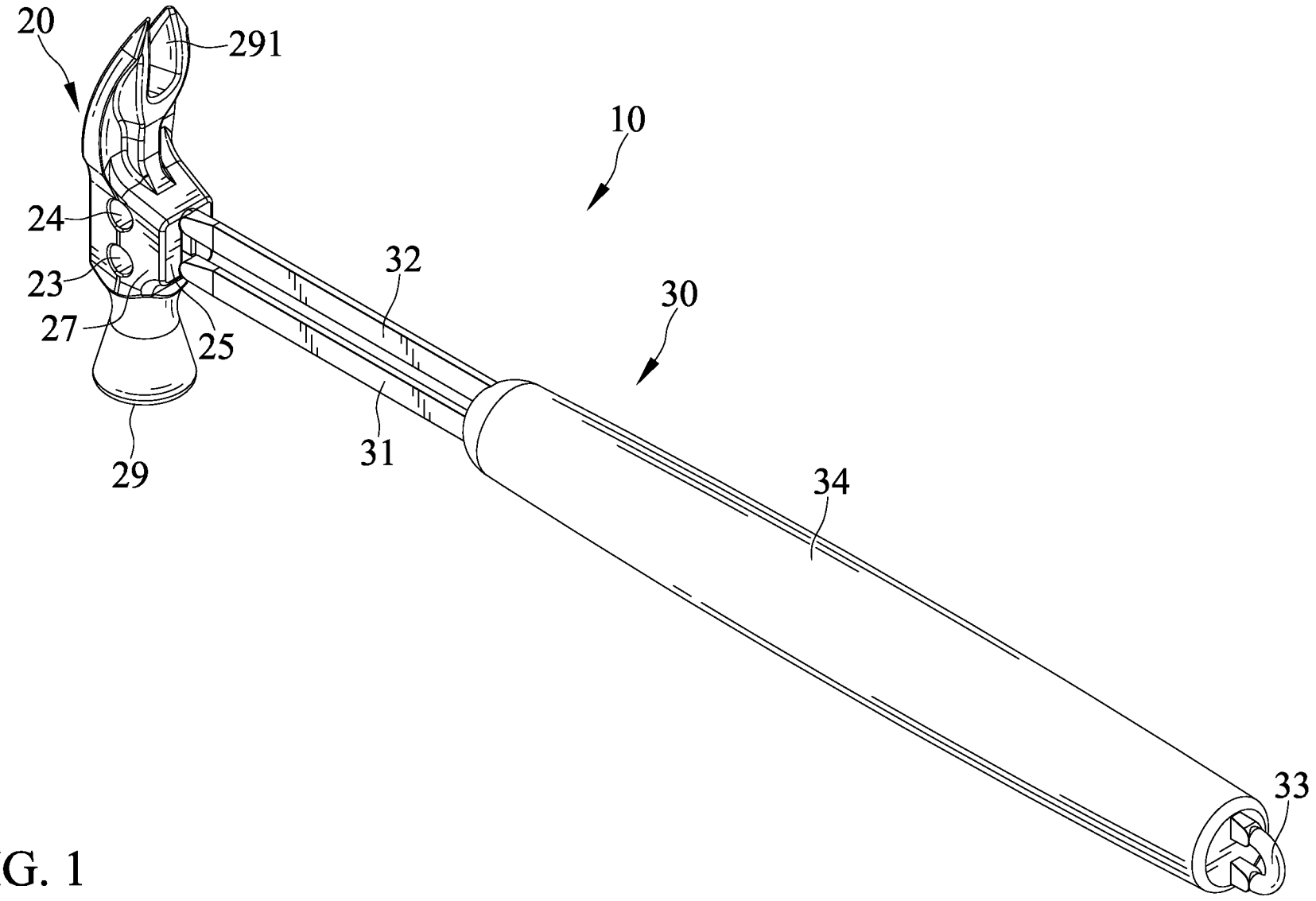
FIG. 1 is a perspective view of a hammer tool in accordance with the present invention.
Figure 2:
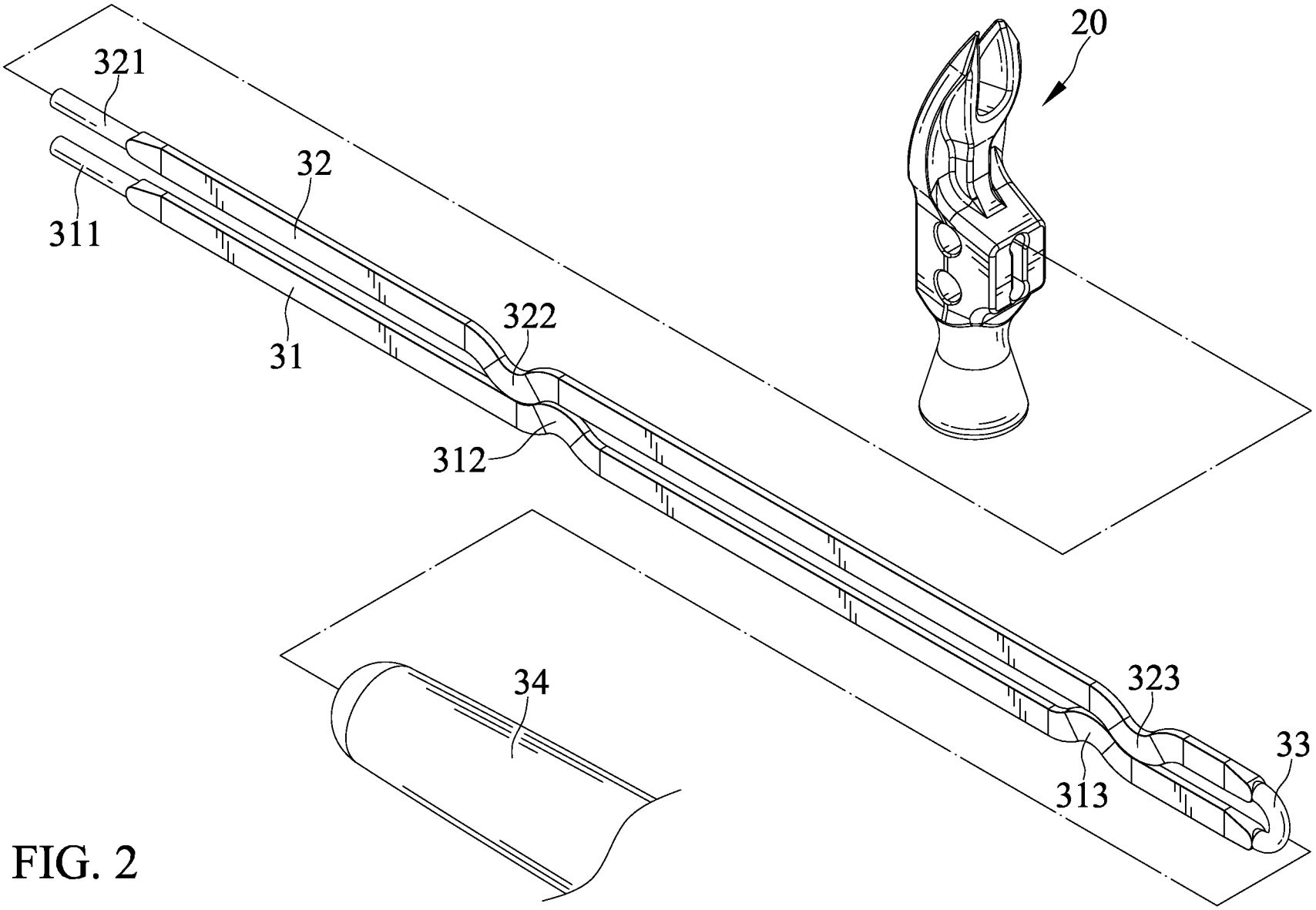
FIG. 2 is an exploded perspective view of FIG. 1.
Figure 3:
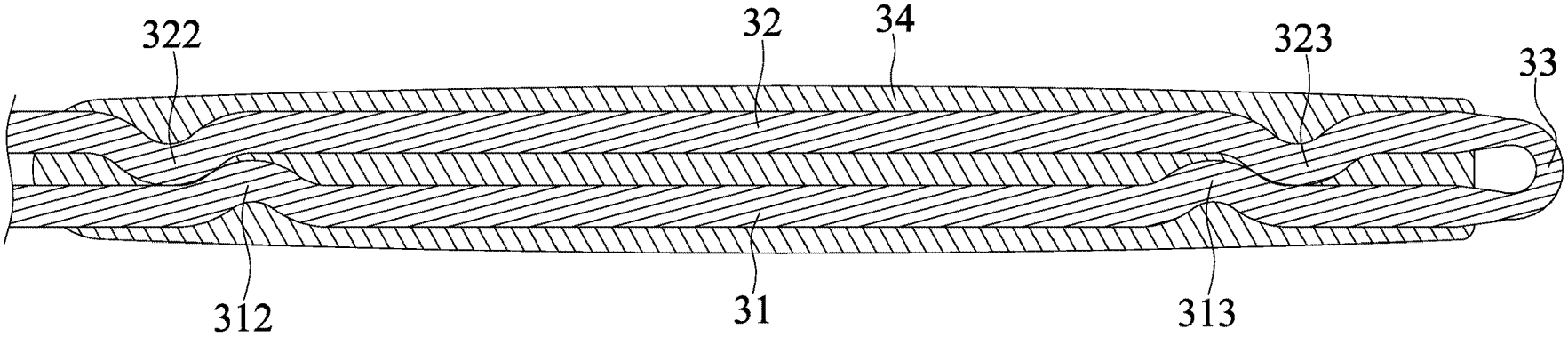
FIG. 3 is a partial, cross-sectional view of FIG. 1
Figure 4:
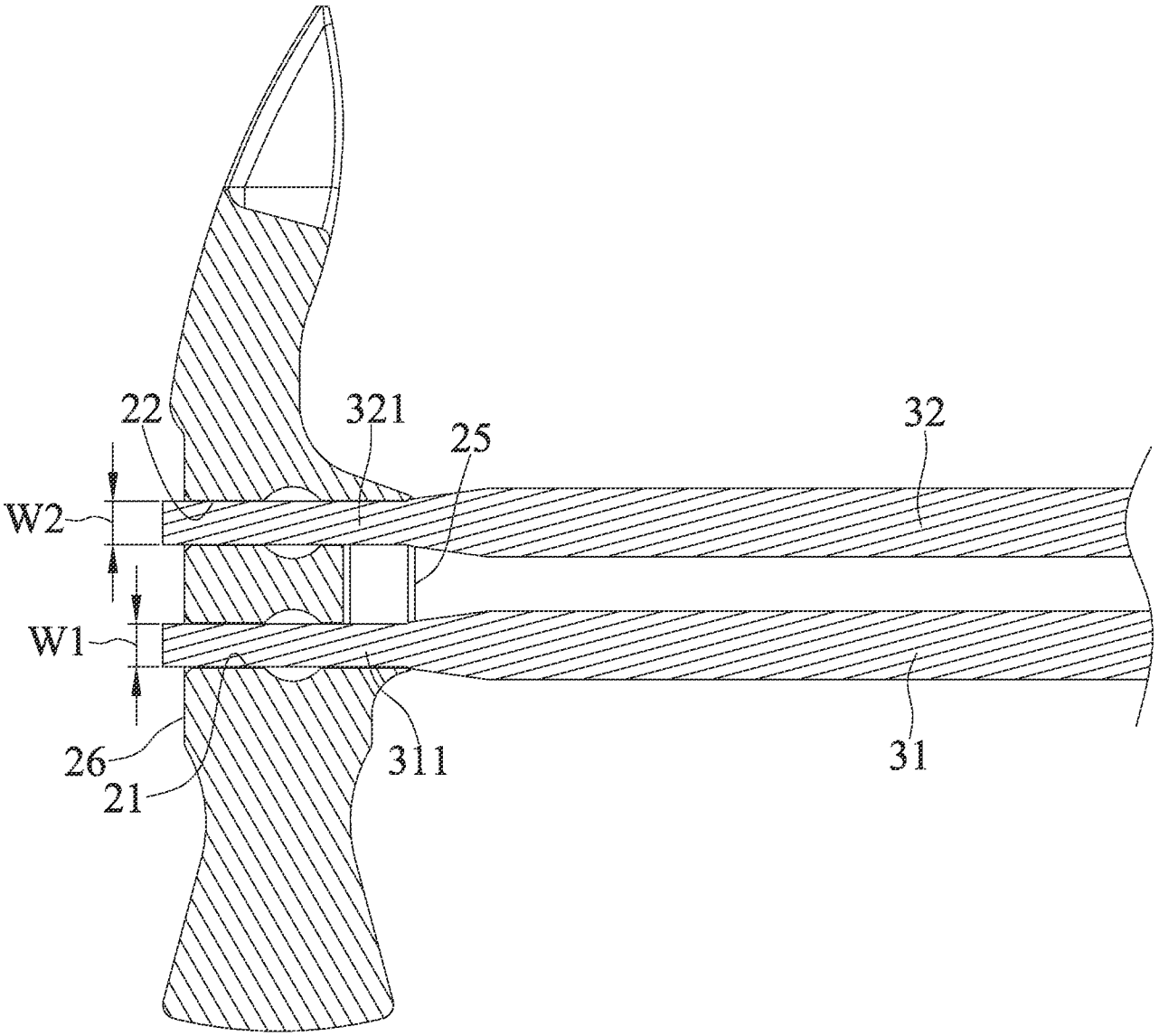
FIGS. 4 and 5 are cross-sectional views of FIG. 1 illustrating a handle inserted into a hammer but not yet secured to a head.
Figure 5:
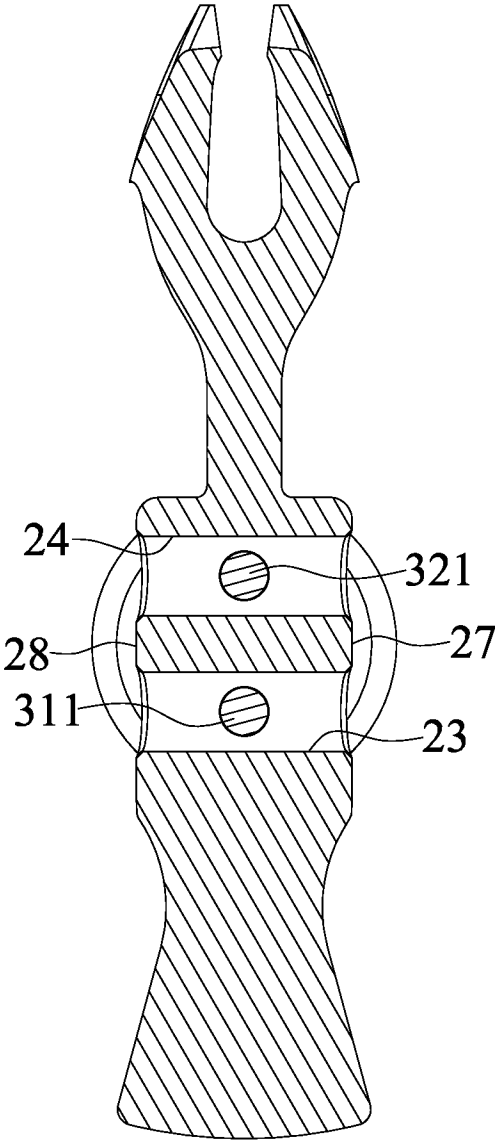
Figure 6:
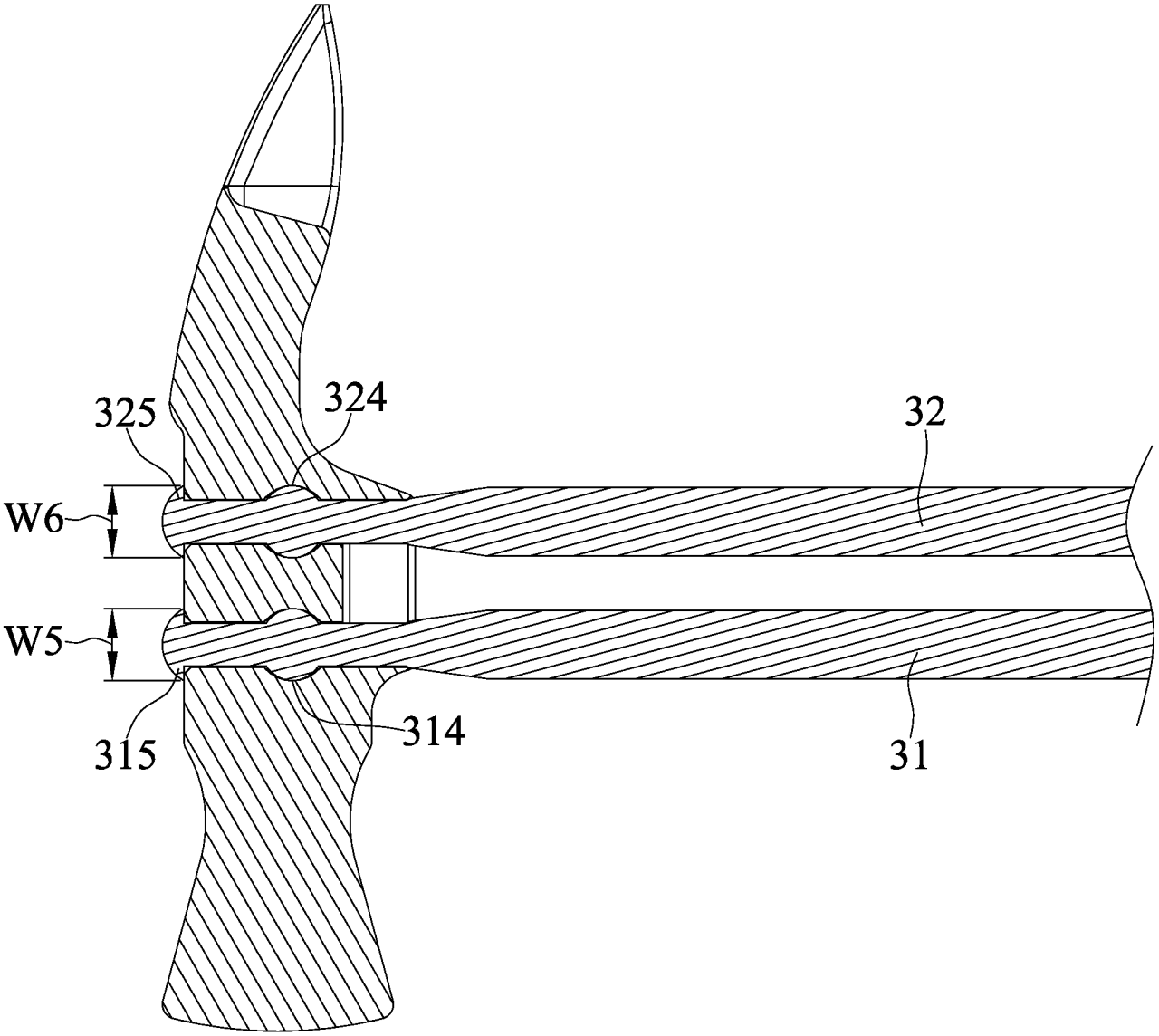
FIGS. 6 and 7 are cross-sectional views illustrating the handle secured to the handle and including a connecting end deformed.

The head 20 defines a first and a second through hole 21 and 22 and a first and a second hole 23 and 24. The first hole 23 is connected to the first through hole 21 and the second hole 24 is connected to the second through holes 22 respectively. The first hole 23 extends transversely to the first through hole 21 and the second hole 24 extends transversely to the second through hole 22 respectively. The first through hole 21 is of a width W1 and the second through hole 22 is of a width W2 respectively, as shown in FIG. 4. The width W1 is the maximum width of the through hole 21. The first and the second through holes 21 and 22 are circular holes. The first hole 23 is of a width greater than the width W1 and the second hole 24 is of a width greater than the width W2 respectively.

The head 20 has an end 25 and an end 26 at opposite ends and a lateral side 27 and a lateral side 28 at opposite sides. The first and the second through holes 21 and 22 extend through the ends 25 and 26 and the first and the second holes 23 and 24 extend through the first and the second lateral sides 27 and 28 respectively. The first and the second holes 23 and 24 extend transversely to the first and the second through holes 21 and 22.

The head 20 has a working portion 29 at an end and a working portion 291 at another end. The working portions 29 and 291 are disposed oppositely in a first direction and the through hole 21 extends in a second direction transverse to the first direction. The working portion 29 has a striking face. The working portion 291 is a claw which is adapted to be used to pry an object.

The handle 30 has a first and a second connecting end 311 and 321 fixed to the head 20. The handle 30 has a first and a second medial section 31 and 32 and the first and the second connecting ends 311 and 321 extend from the first and the second medial sections 31 and 32 respectively. Each of the medial sections 31 and 32 is of a cross section different from a cross section of each of the connecting ends 311 and 321. The first and the second medial sections 31 and 32 extend parallel to each other. The first and the second medial sections 31 and 32 are disposed side by side. The first and the second medial sections 31 and 32 form at least one first and at least one second curved sections 312 and 322 respectively. The first and the second medial sections 31 and 32 are bent to form the at least one first and the at least one second curved sections 312 and 322 respectively. The at least one first and the at least one second curved sections 312 and 322 abut against each other. Since the first and the at least one second curved sections 312 and 322 abut against each other. Thus, the first and the second medial sections 31 and 32 can resist from being deformed. Particularly, each of the at least one first and the at least one second curved sections 312 and 322 has two lateral sides, and one of the two lateral sides of the at least one first curved section 312 abuts against one of the two laterals sides of the at least one second curved section 322. Moreover, each of the at least one first and the at least one second curved sections 312 and 322 has a top between the two lateral sides, and the top of the at least one first curved section 312 is spaced from the second medial section 32 and the top of the at least one second curved section 322 abuts against the first medial section 31. In addition, the embodiment discloses the at least one first curved section including two first curved sections 312 and 313 and the at least one second curved section including two second curved sections 322 and 323. Furthermore, the two first curved sections 312 and 313 are disposed between the two second curved sections 322 and 323.

Figure 7:
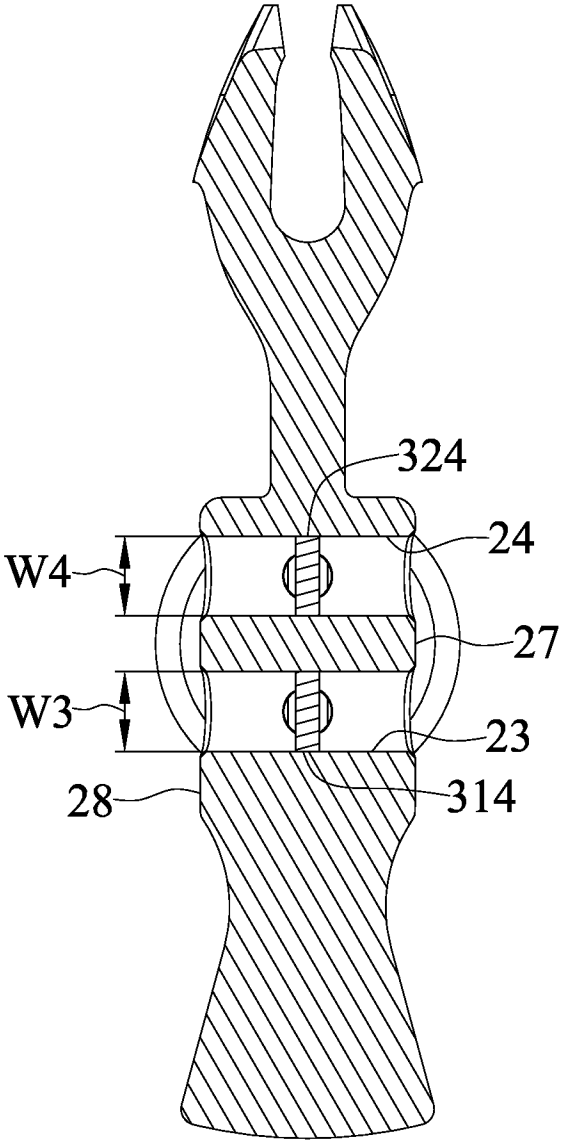

The handle 30 includes the first connecting end 311 inserted through the first through hole 21 and the second connecting end 321 inserted through the second through hole 22 respectively. The first connecting end 311 abuts against an inner periphery of the first through hole 21 and the second connecting end 321 abuts against an inner periphery of the second through hole 22 respectively. The first connecting end 311 is extruded after inserting through the first through hole 21 to include at least one first positioning protrusion 314 protruding into the first hole 23 and the second connecting end 321 is extruded after inserting through the second through hole 22 to include at least one second positioning protrusion 324 protruding into the second hole 24 respectively. The first connecting end 311 is of a width W3 at where the at least one first positioning protrusion 314 is disposed and the second connecting end 321 is of a width W4 at where the at least one second positioning protrusion 324 is disposed respectively, as shown in FIG. 7. The width W3 is greater than the width W1 and the width W4 is greater than the width W2 respectively. The at least one first positioning protrusion 314 tightly abuts against an inner periphery of the first hole 23 and the at least one second positioning protrusion 324 tightly abuts against an inner periphery of the second hole 24 respectively and so the head 20 and the handle 30 are tightly coupled and prevented from moving relative to each other. The width of the hole 23 substantially equals to the width W3 at where the at least one positioning protrusion 314 is disposed and the width of the hole 24 substantially equals to the width W4 at where the at least one positioning protrusion 324 is disposed respectively. In addition, the first connecting end 311 is extruded after inserting through the first through hole 21 to include a first anti-disengagement protrusion 315 disposed outside the first through hole 21 and the second connecting end 321 is extruded after inserting through the second through hole 22 to include a second anti-disengagement protrusion 325 disposed outside the second through hole 22 respectively. The anti-disengagement protrusion 315 and 325 abut against the end 26 of the head 20. The first anti-disengagement protrusion 315 is of a width W5 greater than the width W1 and the second anti-disengagement protrusion 325 is of a width W6 greater than the first width W2 respectively. The first and the second anti-disengagement protrusion 315 and 325 are therefore able to prevent the handle 30 detaching from the head 20.

The handle 30 includes an end forming a U-turn section 33. The U-turn section 33 has a first end connecting to the first medial section 31 and a second end connecting to the second medial section 32 respectively. The U-turn section 33 is of a cross section different from the cross section of each of the medial sections 31 and 32. Each of the medial sections 31 and 32 is of a quadrilateral cross section. The U-turn section 33 is of a circular cross section.

The handle 30 has a main body made in one piece. The handle 30 has a grasp section 34 at an end. The first and the second connecting ends 311 and 321 and the grasp section 34 are at opposite ends in a longitudinal direction of the handle 30. The grasp section 34 has an ergonomic cover mounted thereon. Preferably, the cover is injection molded. The U-turn section 33 is not covered by the grasp section 34. The U-turn section 33 thus defines a hanging hole.

In view of the foregoing, the first and the second medial sections 31 and 32 are prevented from deformation. Further, once the head 20 and the handle 30 are tightly coupled with each other, they are prevented from moving relative to and disengaging from each other.

The foregoing is merely illustrative of the principles of this invention, and various modifications can be made by those skilled in the art without de parting from the scope and spirit of the invention.

What is claimed is:

1. A hammer tool comprising:

a head; and a handle coupled to the head, wherein the handle has a first and a second connecting end fixed to the head, wherein the handle has a first and a second medial section and the first and the second connecting ends extend from the first and the second medial sections respectively, wherein the first and the second medial sections are disposed side by side, wherein the first and the second medial sections form at least one first and at least one second curved sections respectively, and wherein the at least one first and the at least one second curved sections abut against each other;

wherein the head defines a first and a second through hole and a first and a second hole, wherein the first hole is connected to the first through holes and the second hole is connected to the second through holes respectively, wherein the first holes extends transversely to the first through holes and the second hole extends transversely to the second through holes respectively, wherein the first through hole is of a first width and the second through hole is of a second width respectively, wherein the first hole is of a width greater than the first width and the second hole is of a width greater than the second width respectively, wherein the handle tightly coupled to the head and includes the first connecting end inserted through the first through hole and the second connecting end inserted through the second through hole respectively, wherein the first connecting end is extruded after inserting through the first through hole to include at least one first positioning protrusion protruding into the first hole and the second connecting end is extruded after inserting through the second through hole to include at least one second positioning protrusion protruding into the second hole respectively, wherein the first connecting end is of a third width at where the at least one first positioning protrusion is disposed and the second connecting end is of a fourth width at where the at least one second positioning protrusion is disposed respectively, and wherein the third width is greater than the first width and the fourth width is greater than the second width respectively.

2. The hammer tool as claimed in claim 1, wherein the first and the second medial sections extend parallel to each other.

3. The hammer tool as claimed in claim 1, wherein each of the at least one first and the at least one second curved sections has two lateral sides, and wherein one of the two lateral sides of the at least one first curved section abuts against one of the two laterals sides of the at least one second curved section.

4. The hammer tool as claimed in claim 3, wherein each of the at least one first and the at least one second curved sections has a top between the two lateral sides, and wherein the top of the at least one first curved section is spaced from the second medial section and the top of the at least one second curved section abuts against the first medial section.

5. The hammer tool as claimed in claim 4, wherein the at least one first curved section includes two first curved sections, and wherein the at least one second curved section includes two second curved sections.

6. The hammer tool as claimed in claim 3, wherein the at least one first curved section includes two first curved sections, and wherein the at least one second curved section includes two second curved sections.

7. The hammer tool as claimed in claim 1, wherein the handle includes an end forming a U-turn section, and wherein the U-turn section has a first end connecting to the first medial section and a second end connecting to the second medial section respectively.

8. The hammer tool as claimed in claim 7, wherein the handle has a grasp section at an end, and wherein the grasp section is injection molded and the at least one first and the at least one second curved sections is covered by the grasp section, and wherein the U-turn section is not covered by the grasp section.

9. The hammer tool as claimed in claim 1, wherein the handle has a grasp section at an end, and wherein the grasp section is injection molded and the at least one first and the at least one second curved sections is covered by the grasp section.

10. The hammer tool as claimed in claim 1, wherein the first connecting end is of a width at where the at least one first positioning protrusion is disposed greater than the first width, wherein the second connecting end is of a width at where the at least one second positioning protrusion is disposed greater than the second width, and wherein the at least one first positioning protrusion tightly abuts against an inner periphery of the first hole and the at least one second positioning protrusion tightly abuts against an inner periphery of the second hole respectively.

11. The hammer tool as claimed in claim 1, wherein the first connecting end abuts against an inner periphery of the first through hole and the second connecting end abuts against an inner periphery of the second through hole respectively.

12. The hammer tool as claimed in claim 1, wherein the head has a first end and a second end at opposite ends and a first lateral side and a second lateral side at opposite sides, and wherein the first and the second through holes extend through the first and the second ends of the head and the first and the second holes extend through the first and the second lateral sides of the head respectively.

13. The hammer tool as claimed in claim 1, wherein the first connecting end is extruded after inserting through the first through hole to include a first anti-disengagement protrusion disposed outside the first through hole and the second connecting end is extruded after inserting through the second through hole to include a second anti-disengagement protrusion disposed outside the second through hole respectively, and wherein the first anti-disengagement protrusion is of a fifth width greater than the first width and the second anti-disengagement protrusion is of a sixth width greater than the first width respectively.

14. The hammer tool as claimed in claim 13, wherein the head has a first end and a second end at opposite ends and the first and the second anti-disengagement protrusion abuts against the second end.

15. The hammer tool as claimed in claim 13, wherein each of the at least one first and the at least one second curved sections has two lateral sides, and wherein one of the two lateral sides of the at least one first curved section abuts against one of the two laterals sides of the at least one second curved section.

16. The hammer tool as claimed in claim 1, wherein the head has a first working portion at an end and a second working portion at another end, and wherein the first and the second working portions are disposed oppositely in a first direction and the first and the second through holes extend in a second direction transverse to the first direction.

17. The hammer tool as claimed in claim 16, wherein the first working portion has a striking face.

18. The hammer tool as claimed in claim 16, wherein the second working portion has a claw.

* * * * *